US006832704B2

(12) United States Patent
Smith

(10) Patent No.: US 6,832,704 B2
(45) Date of Patent: Dec. 21, 2004

(54) METERING VALVE FOR AEROSOL CONTAINER

(75) Inventor: Jeremy P. Smith, Loudon, NH (US)

(73) Assignee: Summit Packaging Systems, Inc., Manchester, NH (US)

( * ) Notice: Subject to any disclaimer, the term of this patent is extended or adjusted under 35 U.S.C. 154(b) by 140 days.

(21) Appl. No.: 10/174,407

(22) Filed: Jun. 17, 2002

(65) Prior Publication Data

US 2003/0230602 A1 Dec. 18, 2003

(51) Int. Cl.[7] ..... B65D 83/54

(52) U.S. Cl. ..... 222/402.1; 222/402.2

(58) Field of Search ..... 141/20; 222/402.1, 222/402.16, 402.2, 402.24

(56) References Cited

U.S. PATENT DOCUMENTS

| | | | | |
|---|---|---|---|---|
| 2,631,814 A | | 3/1953 | Abplanalp | 251/137 |
| 2,701,163 A | | 2/1955 | Teller et al. | 299/95 |
| 2,723,055 A | | 11/1955 | Beard, Jr. | 222/394 |
| 2,856,235 A | | 10/1958 | Ward | 299/95 |
| 2,867,356 A | | 1/1959 | Thomas | 222/148 |
| 2,932,432 A | * | 4/1960 | Beard, Jr. | 222/402.2 |
| 2,998,168 A | * | 8/1961 | Walkherr | 222/402.2 |
| 3,055,560 A | | 9/1962 | Meshberg | 222/394 |
| 3,073,489 A | | 1/1963 | Friedman | 222/394 |
| 3,158,298 A | | 11/1964 | Briechle | 222/394 |
| 3,180,374 A | | 4/1965 | Muller | 141/20 |
| 3,186,605 A | | 6/1965 | Potoczky | 222/394 |
| 3,219,069 A | | 11/1965 | Kuffer | 141/20 |
| 3,313,459 A | * | 4/1967 | Ryuichi | 222/402.2 |
| 3,319,669 A | | 5/1967 | Abplanalp | 141/20 |
| 3,375,957 A | | 4/1968 | Kuffer | 222/402.16 |
| 3,567,081 A | | 3/1971 | Meshberg | 222/402.17 |
| 3,581,946 A | | 6/1971 | Meshberg | 222/136 |
| 3,581,958 A | | 6/1971 | Meshberg | 222/542 |
| 3,583,606 A | | 6/1971 | Ewald | 222/402.18 |
| 3,583,608 A | | 6/1971 | Green | 222/402.24 |
| 3,589,571 A | | 6/1971 | Green | 222/402.24 |
| 3,612,361 A | | 10/1971 | Ewald | 222/402.18 |
| 3,637,114 A | | 1/1972 | Meshberg | 222/135 |
| 3,651,997 A | | 3/1972 | Venus, Jr. | 222/402.16 |
| 3,756,465 A | | 9/1973 | Meshberg | 222/61 |
| 3,777,946 A | | 12/1973 | Livingstone | 222/402.2 |
| 3,791,561 A | | 2/1974 | Ewald | 222/396 |
| 3,813,013 A | | 5/1974 | Kotuby et al. | 222/402.2 |
| 3,845,887 A | | 11/1974 | Meuresch et al. | 222/402.16 |
| 3,848,778 A | | 11/1974 | Meshberg | 222/402.11 |
| 3,858,762 A | | 1/1975 | Meshberg | 222/180 |

(List continued on next page.)

FOREIGN PATENT DOCUMENTS

| | | | |
|---|---|---|---|
| DE | 198 35 273 | 3/1999 | B65D/83/54 |
| DE | 201 14 780 | 1/2002 | B65D/83/54 |
| EP | 0 350 376 B1 | 1/1990 | B65D/83/54 |

(List continued on next page.)

*Primary Examiner*—Kenneth Bomberg
(74) *Attorney, Agent, or Firm*—Davis & Bujold, P.L.L.C.

(57) ABSTRACT

A metering valve assembly comprising a ferrule and a valve housing defining an internal cavity. The valve housing accommodates an annular flange and a compression spring therein with a valve gasket closing the internal cavity. The valve housing is attached to the ferrule such that a stem portion of the valve stem protrudes through apertures provided in both the valve gasket and the ferrule. A stem portion has a discharge passageway which is normally closed by the valve gasket. Either an undersurface of the annular flange or a mating surface of the valve housing is provided with an compressible sealing member while the other is provided with an annular edge. The compressible sealing member and the annular edge form a seal therebetween, when the valve stem is sufficiently depressed, to partition the interior cavity into a metering chamber and a separate filling chamber whereby product may only be dispensed solely from the metering chamber when a product flow path is established.

21 Claims, 4 Drawing Sheets

U.S. PATENT DOCUMENTS

| | | | | |
|---|---|---|---|---|
| 3,920,158 | A | 11/1975 | Meshberg | 222/135 |
| 3,927,806 | A | 12/1975 | Meshberg | 222/402.12 |
| 3,949,910 | A | 4/1976 | Focht | 222/321 |
| 3,949,912 | A | 4/1976 | Meshberg et al. | 222/394 |
| 3,986,248 | A | 10/1976 | Meshberg et al. | 29/458 |
| 4,008,830 | A | 2/1977 | Meshberg | 222/95 |
| 4,015,752 | A | 4/1977 | Meuresch et al. | 222/402.16 |
| 4,015,757 | A | 4/1977 | Meuresch et al. | 222/402.16 |
| 4,034,899 | A | 7/1977 | Meshberg | 222/321 |
| 4,061,247 | A | 12/1977 | Meshberg | 222/1 |
| 4,062,517 | A | 12/1977 | Jones | 251/322 |
| 4,078,705 | A | 3/1978 | Butcher | 222/402.24 |
| 4,113,145 | A | 9/1978 | Meshberg | 222/1 |
| 4,135,648 | A | 1/1979 | White | 222/402.2 |
| 4,230,242 | A | 10/1980 | Meshberg | 222/321 |
| 4,271,875 | A | 6/1981 | Meshberg | 141/3 |
| 4,311,255 | A | 1/1982 | Meshberg | 222/183 |
| 4,324,351 | A | 4/1982 | Meshberg | 222/402.11 |
| 4,362,257 | A | 12/1982 | Shay | 222/402.2 |
| 4,389,003 | A | 6/1983 | Meshberg | 222/321 |
| 4,413,755 | A | 11/1983 | Brunet | 222/402.2 |
| 4,427,137 | A | 1/1984 | Dubini | 222/402.2 |
| 4,434,914 | A | 3/1984 | Meshberg | 222/153 |
| 4,435,135 | A | 3/1984 | Knickerbocker | 417/511 |
| 4,441,634 | A | 4/1984 | Meshberg | 222/402.16 |
| 4,456,153 | A | 6/1984 | Meshberg | 222/321 |
| 4,457,454 | A | 7/1984 | Meshberg | 222/95 |
| 4,457,455 | A | 7/1984 | Meshberg | 222/105 |
| 4,577,784 | A | 3/1986 | Brunet | 222/402.2 |
| 4,597,512 | A | 7/1986 | Wilmot | 222/402.2 |
| 4,696,415 | A | 9/1987 | Meshberg | 222/82 |
| 4,702,400 | A | 10/1987 | Corbett | 222/402.2 |
| 4,735,347 | A | 4/1988 | Schultz et al. | 222/321 |
| 4,811,868 | A | 3/1989 | Nitta | 222/462.2 |
| 4,842,168 | A | 6/1989 | Bougamont et al. | 222/402.2 |
| 4,858,790 | A | 8/1989 | Howlett | 222/402.2 |
| 4,867,352 | A | 9/1989 | Meshberg | 222/402.16 |
| 4,895,279 | A | 1/1990 | Schultz | 222/321 |
| 4,942,985 | A | 7/1990 | Schultz | 222/376 |
| 4,953,759 | A | 9/1990 | Schmidt | 222/402.2 |
| RE33,552 | E | 3/1991 | Bougamont et al. | 222/402.16 |
| 5,027,985 | A | 7/1991 | Abplanalp | 222/402.1 |
| 5,037,013 | A | 8/1991 | Howlett | 222/402.2 |
| 5,085,351 | A | 2/1992 | Martin | 222/287 |
| 5,100,029 | A | 3/1992 | Meshberg | 222/148 |
| 5,158,211 | A | 10/1992 | Meshberg | 222/153 |
| 5,169,038 | A | 12/1992 | Di Giovanni | 222/402.2 |
| 5,183,186 | A | 2/1993 | Delaney, Jr. | 222/211 |
| 5,222,636 | A | 6/1993 | Meuresch | 222/321 |
| 5,263,616 | A | 11/1993 | Abplanalp | 222/402.13 |
| 5,265,771 | A | 11/1993 | Meshberg | 222/207 |
| 5,273,191 | A | 12/1993 | Meshberg | 222/105 |
| 5,290,539 | A | 3/1994 | Marecki | 424/45 |
| 5,301,846 | A | 4/1994 | Schmitz | 222/211 |
| 5,305,810 | A | 4/1994 | Meshberg | 141/374 |
| 5,310,112 | A | 5/1994 | Meshberg | 222/482 |
| 5,318,205 | A | 6/1994 | Delaney, Jr. | 222/211 |
| 5,343,901 | A | 9/1994 | Meshberg | 141/2 |
| 5,348,199 | A | 9/1994 | Smith | |
| 5,363,992 | A | 11/1994 | Meshberg | 222/309 |
| 5,363,993 | A | 11/1994 | Mascitelli et al. | 222/321 |
| 5,370,862 | A | 12/1994 | Klokkers-Bethke et al. | 424/47 |
| 5,392,962 | A | 2/1995 | Meshberg | 222/321 |
| 5,433,343 | A | 7/1995 | Meshberg | 222/25 |
| 5,460,207 | A | 10/1995 | Meshberg | 141/1 |
| 5,516,006 | A | 5/1996 | Meshberg | 222/25 |
| 5,593,064 | A | 1/1997 | Meshberg | 222/39 |
| 5,620,113 | A | 4/1997 | Meshberg | 222/1 |
| D383,382 | S | 9/1997 | Meshberg | D9/300 |
| 5,667,104 | A | 9/1997 | Meshberg | 222/143 |
| 5,702,031 | A | 12/1997 | Meshberg et al. | 222/1 |
| D402,542 | S | 12/1998 | Meshberg | D9/300 |
| 5,875,932 | A | 3/1999 | Meshberg | 222/153.13 |
| 5,906,046 | A | 5/1999 | Abplanalp et al. | 29/890.124 |
| 5,918,778 | A | 7/1999 | Schultz | 222/321.7 |
| 5,938,085 | A | 8/1999 | Conroy et al. | 222/402.2 |
| RE36,410 | E | 11/1999 | Meshberg | 141/2 |
| 5,975,378 | A | 11/1999 | Bayer | 222/402.24 |
| 6,003,737 | A | 12/1999 | Mascitelli | 222/321.2 |
| 6,006,745 | A | 12/1999 | Marecki | 128/200.23 |
| 6,016,974 | A | 1/2000 | Mascitelli | 239/333 |
| 6,039,306 | A | 3/2000 | Pericard et al. | 251/353 |
| 6,047,856 | A | 4/2000 | Meshberg et al. | 222/1 |
| 6,047,946 | A | 4/2000 | Kolanus | 251/89 |
| 6,092,698 | A | 7/2000 | Bayer | 222/402.25 |
| 6,126,042 | A | 10/2000 | Meshberg | 222/321.4 |
| 6,131,777 | A | 10/2000 | Warby | 222/402.2 |
| 6,170,713 | B1 | 1/2001 | Schultz | 222/321.2 |
| 6,170,717 | B1 | 1/2001 | Di Giovanni et al. | 222/402.2 |
| 6,202,900 | B1 | 3/2001 | Tsutsui et al. | 222/402.2 |
| 6,247,613 | B1 | 6/2001 | Meshberg | 222/1 |
| 6,254,104 | B1 | 7/2001 | Hafner | 277/590 |
| 6,267,304 | B1 | 7/2001 | Schultz | 239/327 |
| 6,296,155 | B1 | 10/2001 | Smith | |
| 6,357,633 | B1 | 3/2002 | Zimmerhackel et al. | 222/402.1 |
| 6,375,046 | B1 | 4/2002 | Alleard et al. | 222/386.5 |
| 6,382,463 | B2 | 5/2002 | Meshberg | 222/1 |
| 6,394,321 | B1 | 5/2002 | Bayer | 222/402.24 |

FOREIGN PATENT DOCUMENTS

| | | | |
|---|---|---|---|
| EP | 0 352 915 | 1/1990 | B65D/83/54 |
| EP | 0 350 376 B1 | 1/1993 | B65D/83/54 |
| EP | 0 798 233 A2 | 10/1997 | B65D/83/44 |
| FR | 1 162 829 A | 9/1958 | |
| FR | 2 767 801 | 3/1999 | B65D/83/54 |
| WO | WO 90/12743 | 11/1990 | |
| WO | 92/07777 | 5/1992 | B65D/83/14 |
| WO | 92/11190 | 7/1992 | B65D/83/14 |
| WO | 00/26116 | 5/2000 | B65D/83/14 |
| WO | 02/10037 | 2/2002 | B65D/83/54 |

* cited by examiner 30
34
50

D
U
42
C
34
30
66
68
8
62
22
64
74
60
58
78

34
50

D
U
42
B
34
50
66
68
70
58
8
22
64
74
65
28
62
78

METERING VALVE FOR AEROSOL CONTAINER

FIELD OF THE INVENTION

The present invention relates to a metering valve assembly for dispensing a premeasured quantity of a product from an aerosol container once the stem of the aerosol valve is sufficiently depressed.

BACKGROUND OF THE INVENTION

A number of metering valves are currently available in the market place. Most of these currently available metering valves utilize a ball or some other additional component which has to be separately installed in the valve housing to ensure proper metering of a desired quantity of an aerosol product from the valve assembly upon sufficient actuation or depression of the stem. The installation of this additional component, during manufacture of the aerosol valve, generally increases the production costs as well as the inspection costs associated with manufacture of the aerosol valve. Moreover, if the additional component is not properly installed or is omitted from the valve assembly for some reason, the aerosol valve will malfunction. Accordingly, an inspection step is generally required, following installation of the additional component, to confirm that the additional component was, in fact, properly installed within the aerosol valve.

Another drawback associated with prior art metering valves is that such valves have a tendency to "throttle". That is, due to a poor or an improper valve design, it is possible for an operator to partially depress the valve stem and establish a product flow path from the interior cavity of the aerosol container through the metering valve and out through a spray button or an actuator affixed to the stem of the aerosol valve, prior to the valve stem sealing the inlet to the valve housing, so that product may be continuously discharged out through the aerosol valve. As a result of such throttling, the operator is able to dispense a continuous discharge of product from the aerosol container via the metering valve. This results in the inadvertent discharge of excess product from the aerosol container which is wasteful and generally to be avoided.

Another prior art design utilizes a frictional sealing fit between two plastic valve components to separate the contents of the container from the metering chamber. This arrangement requires that the valve spring be sufficiently forceful to overcome the interference fit of this sealing device upon the valve closing sequence. Apart from being subject to size and hardness changes due to immersion in the product, this design mandates extremely close tolerances of the mating components and critical alignment of molded parts during the valve assembly operation. Failure to observe these manufacturing tolerances and alignment criteria leads to an inaccurate metered spray or a valve which will not "shut-off" and thus result in the total release of the entire product contents.

SUMMARY OF THE INVENTION

Wherefore, it is an object of the present invention to overcome the above noted drawbacks associated with the prior art aerosol metering valves.

Another object of the present invention is to minimize the amount of separate components that must be separately assembled, during manufacture of the valve assembly, to improve the easy of assembly of the metering valve assembly.

Yet another object of the present invention is to provide a metering valve assembly which reliably, consistently and accurately dispenses a desired quantity of the product contents from the metering valve assembly.

A still further object of the present invention is to provide a metering valve assembly which can be reliably manufactured while minimizing the degree of inspection required for manufacture of the metering valve assembly.

A further object of the present invention is to provide a metering valve assembly which prevents inadvertent "throttling" of the metering valve assembly by an operator.

The present invention also relates to a ferrule having an aperture formed therein; a valve housing having an inlet provided in a base wall thereof, the valve housing defining an internal cavity which accommodates an annular flange of a valve stem and a compression spring therein, and a valve gasket closing the internal cavity; the valve housing being attached to the ferrule such that a stem portion of the valve stem protrudes through an aperture provided in the valve gasket and through the aperture provided in the ferrule; and the stem portion having a passageway formed therein communicating with a dispensing outlet, and an opposite end of the passageway communicating with at least one radial passageway; and the at least one radial passageway being normally closed by the valve gasket due to the spring normally biasing the valve stem into a closed position; wherein one of an undersurface of the annular flange of the valve stem and a mating surface of the valve housing is provided with an compressible sealing member and the other of the undersurface of the valve stem and the mating surface of the valve housing is provided with an annular sealing edge, and the compressible sealing member and the annular sealing edge form a seal therebetween, when the valve stem is sufficiently depressed, to partition the interior cavity into a metering chamber and a separate filling chamber so that product may be dispensed solely from the metering chamber when a product flow path is established between the metering chamber and the dispensing outlet of the valve stem.

The present invention also relates to a method of metering dispensing of product through a metering valve assembly, the method comprising the steps of: forming an aperture in a ferrule; providing an inlet in a wall of a valve housing and defining, via the valve housing, an internal cavity which accommodates an annular flange of a valve stem and a compression spring therein, and closing the internal cavity by a valve gasket; attaching the valve housing to the ferrule such that a stem portion of the valve stem protrudes through an aperture provided in the valve gasket and through the aperture provided in the ferrule; and forming a passageway in the stem portion which communicates with a dispensing outlet of the metering valve assembly, while an opposite end of the passageway communicates with at least one radial passageway; and normally closing the at least one radial passageway the valve gasket due to the spring normally biasing the valve stem into a closed position; providing one of an undersurface of the annular flange of the valve stem and a mating surface of the valve housing with an compressible sealing member and providing the other of the undersurface of the valve stem and the mating surface of the valve housing with an annular sealing edge, and forming a seal between the compressible sealing member and the annular sealing edge when the valve stem is sufficiently depressed, to partition the interior cavity into a metering chamber and a separate filling chamber, so that product may be dispensed only from the metering chamber when a product flow path is established between the metering chamber and the dispensing outlet of the valve stem.

In the following description and appended drawings, the terms "inward" and "downward" mean toward a lower bottom portion of the respective drawing while the terms "top" and upward" mean toward an upper portion of the respective drawing.

BRIEF DESCRIPTION OF THE DRAWINGS

The invention will now be described, by way of example, with reference to the accompanying drawings in which.

DETAILED DESCRIPTION OF THE INVENTION

Figure 1:
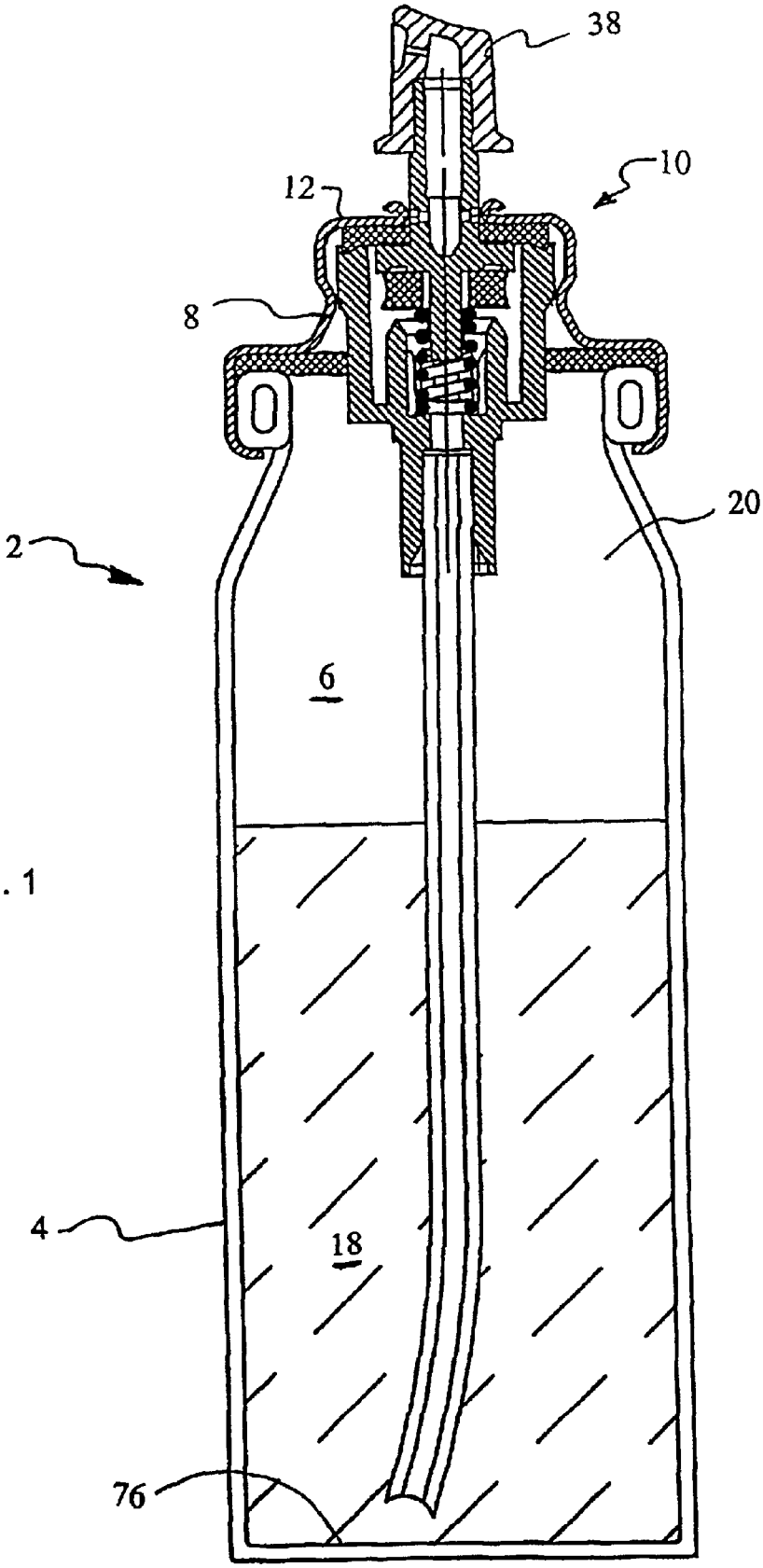
FIG. 1 is a diagrammatic view of a pressurized container containing a metering valve assembly according to the present invention.

Turning first to FIG. 1, an aerosol or pressurizable canister or container 2 is generally shown and it comprises a base container 4, defining a product/propellent cavity 6 therein, which has an opening in a top portion of the base container 4 for receiving either a mounting cup or a conventional ferrule 8 (for the sake of simplicity, the term ferrule will be used throughout the remainder of the specification and the claims but it is to be understood that the invention is also applicable for use with a mounting cup). Prior to the ferrule 8 being attached to the base container 4, a metering valve assembly 10, typically comprising a vertical depressible valve, is crimped to a pedestal portion 12 of the ferrule 8 in a conventional manner. Once this has occurred, the ferrule 8, with the attached metering valve assembly 10, is installed in an opening in the top of the base container 4 and an outer periphery of the ferrule 8 is crimped or otherwise secured to the base container 4, in a conventional manner, to form the pressurizable container 2. Thereafter, as is conventionally done in the art, the product/propellent cavity 6 of the pressurizable container 2 is filled with a desired product to be dispensed 18 as well as a desired propellent 20 to facilitate dispensing of the desired product to be dispensed 18. As the above is conventional and well known in the art, a further detailed description concerning the same is not provided.

Turning now to FIGS. 2–4A, a detailed description concerning the first embodiment of the metering valve assembly, according to the present invention, will now be provided. As can be seen in these Figures, the ferrule 8 supports the metering valve assembly 10. The metering valve assembly 10 comprises a valve housing 22 having an internal cavity 24 which supports a lower portion of an upstanding valve stem 26, a compression spring 28 and a valve gasket 30. The valve stem 26 and the compression spring 28 are assembled within the internal cavity 24 of the valve housing 22 and the valve gasket 30 covers the opening of the valve housing 22 and this assembly is then clamped or crimped to the ferrule 8 via a plurality of indentations or crimps, e.g., the plurality of indentations or crimps are formed inwardly from the exterior of the sidewall of the pedestal portion 12 to permanently attach the metering valve assembly 10 to the ferrule 8. The crimping operation forces the valve housing 22 slightly upward, relative to the ferrule 8, to bias and compressively seal the valve gasket 30 against the inwardly facing surface of the ferrule 8. A stem portion 34 of the valve stem 26 protrudes through a central aperture 36 provided in the pedestal portion 12 of the ferrule 8 as well as a central aperture (not numbered) provided in the valve gasket 30 and the stem portion 34 supports an actuator 38 (see FIG. 1). The actuator 38 has a central product inlet or aperture therein which receives or fits over an exterior surface of the stem portion 34. The product inlet, in turn, communicates with a dispensing outlet of the actuator 38 via an actuator passageway, as is well known in the art.

Figure 2A:
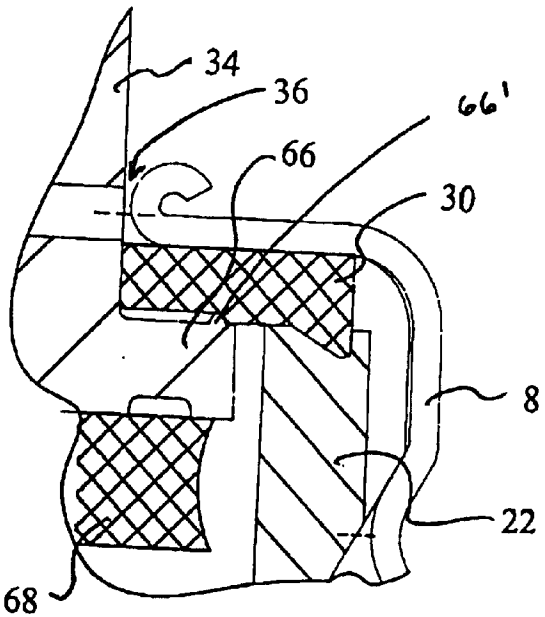
FIG. 2A is an enlarged diagrammatic view of area A of FIG. 2.
Figure 2:
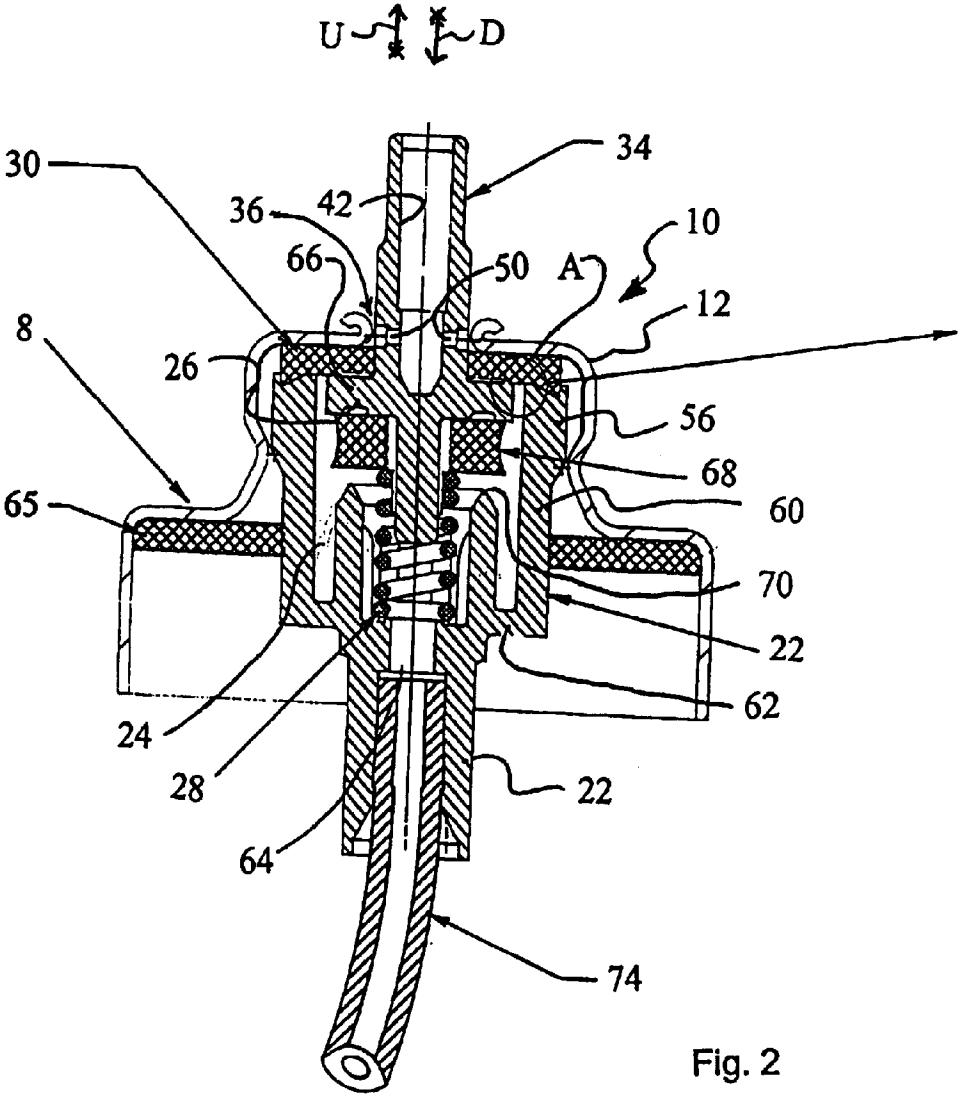
FIG. 2 is a diagrammatic cross-sectional view of a metering valve assembly, according to the present invention, shown in a normally biased closed position.
Figures 3, 3A, 4, 4A:
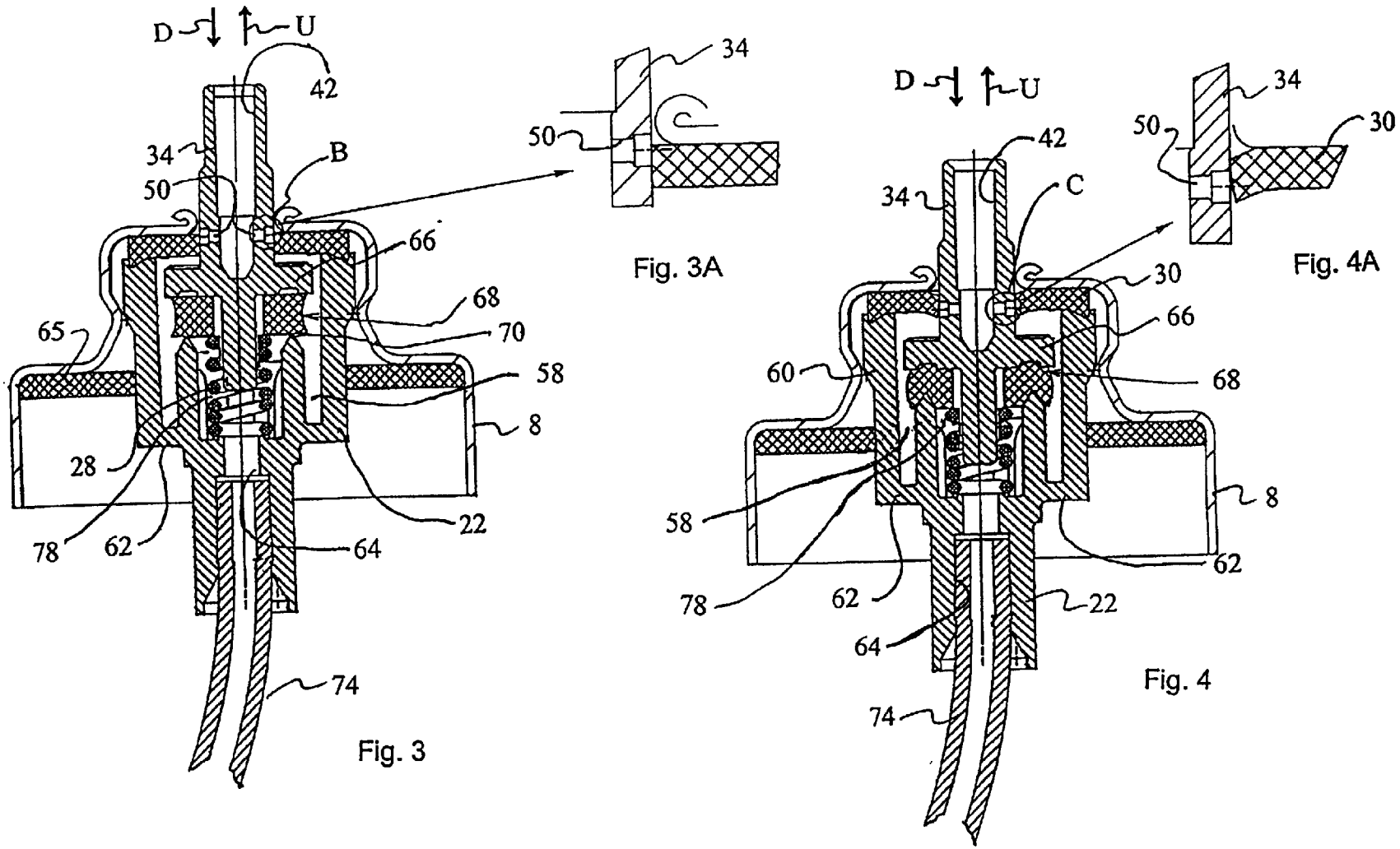
FIG. 3 is a diagrammatic cross-sectional view, of the metering valve assembly of FIG. 2, showing the metering valve assembly in a partially depressed position where the valve stem seals with the annular sealing edge of the valve housing.
FIG. 3A is an enlarged diagrammatic view of area B of FIG. 3.
FIG. 4 is a diagrammatic cross-sectional view, of the metering valve assembly of FIG. 2, showing the fully depressed position of the aerosol valve so that the product contents, from the metering chamber, are discharged out through the stem.
FIG. 4A is an enlarged diagrammatic view of area C of FIG. 4.

The stem portion 34 has a central passageway 42 with a dispensing outlet which communicates with product inlet of the actuator 38. The opposite end of the central passageway 42 communicates with at least one radial passageway 50, and possibly two, three, four or more radial passageway(s) 50 generally equally spaced about the circumference of the stem portion 34 of the valve stem 26. Each one of the radial passageway(s) 50 is normally temporarily blocked from discharging product due to its sealingly engagement with an inwardly facing surface of the valve gasket 30 when the metering valve assembly is both in its normally closed position, as can be seen in FIG. 2, and in its partially closed position, as can be seen in FIG. 3. When the valve stem 26 is substantially completely depressed by an operator (see FIG. 4), the seal between the valve gasket 30 and the at least one radial passageway(s) 50 is broken and a product flow path is established from the metering chamber 58 of the valve housing 22 through the at least one radial passageway(s) 50 and out through the central passageway 42 and the actuator 38 into the surrounding environment.

The valve housing 22 generally has a thickened mouth 56. The valve housing 22 also includes a side wall 60 and a base wall 62 which is provided with a housing inlet 64. During the crimping operation with the pedestal portion 12, the plurality of indentations or crimps engage a lower portion of the thickened mouth 56 and force the valve housing 22 upwardly so as to compress and seal the valve gasket 30 against the inwardly facing surface of the ferrule 8 in a conventional manner. A ferrule gasket 65 is accommodated within the ferrule 8 and the ferrule gasket 65 has a central aperture formed therein which receives the valve housing 22 therein and facilitates forming a fluid tight seal with the valve housing 22 and the opening of the base container 4 when the ferrule 8 is secured to the base container 4 to form the pressurizable container 2 (see FIG. 1). If a mounting cup is utilized instead of the ferrule, the mounting cup generally has a polypropylene layer provided on an inwardly facing surface thereof for forming a fluid tight seal with the opening of the base container 4, when the mounting cup 8 is crimped thereto, to form the pressurizable container 2, and thus an additional gasket is generally not required.

The valve stem 26 includes an annular flange 66 which is formed integral therewith in an intermediate region of the valve stem 26. If desired, an annular recess may be formed in an undersurface of the annular flange 66 to receive and center a top portion of the spring 28. An annular rib 66' (see FIG. 2A) is formed on an top surface of the annular flange 66 to facilitate forming a seal with an undersurface of the valve gasket 30. A downwardly facing surface of the annular flange 66 is provided with an compressible sealing member 68 while an upwardly facing and mating surface of the base wall 62 supports an integral annular sealing edge 70. The compressible sealing member 68 may be adhesively secured to or otherwise permanently affixed to the downwardly facing surface of the annular flange 66 to ensure a permanent attachment thereto. Alternatively, the compressible sealing member 68 may merely be secured to the downwardly facing surface of the annular flange 66 by a fictional connection with a lower portion of the valve stem 26. The compressible sealing member 68 and the annular sealing edge 70 are normally spaced apart from one another by a small distance, e.g., about 0.020 of an inch to about 0.040 of an inch so that when the valve stem 26 is at least partially depressed, the compressible sealing member 68 engages with the annular sealing edge 70 to form a fluid tight seal between those two components. The spring 28 is compressibly disposed between the base wall 62 and the annular flange 66 to urge the valve stem 26 away from the base wall 62 into its elevated normally closed position. Upon initially engagement between the compressible sealing member 68 and the annular sealing edge 70 (see FIG. 3), the at least one radial passageway(s) 50 is still normally closed off by abutting engagement between the valve portion 34 of the valve stem 26 and the valve gasket 30 (see FIG. 3A).

The housing inlet 64 formed in the base wall of the valve housing 22 is coupled to a leading end of a product dip tube 74. A remote end of the product dip tube 74 communicates with a base 76 of the pressurizable container 2 to facilitate dispensing of the product to be dispensed therefrom. The housing inlet 64 is sized to receive the leading end of the dip tube 74 and at least the leading end has an interference fit with the housing inlet 64 to ensure a secure connection between those two components. The housing inlet 64 may have an annular protrusion (not numbered) to assist with retention of the leading end of the dip tube 74 within the housing inlet 64.

The annular sealing edge 70 and the compressible sealing member 68 together facilitate dividing, separating or partitioning the internal cavity 24 of the valve housing 22 into two chambers, namely, a centrally located filling chamber 78 and a radially outwardly located metering chamber 58. Due to this arrangement, when the valve stem 26 is sufficiently depressed in the direction of arrow D, the valve stem 26 partially compresses the spring 28 and moves the annular flange 66 and the compressible sealing member 68, supported by the undersurface thereof, into an abutting engagement with the annular sealing edge 70. Once the compressible sealing member 68 and the annular sealing edge 70 sufficiently engaged with one another, such engagement partitions the internal cavity 24 into the filling chamber 78 and the radially outwardly located metering chamber 58. Such engagement prevents the further flow of product to be dispensed from the filling chamber 78 into the metering chamber 58. It is to be appreciated that the valve gasket 30 is still maintained in sealing engagement with the exterior surface of the valve portion 34 of the valve stem 26 so that the dispensing of product through the at least one radial passageway(s) 50 and the central passageway 42 is not permitted.

Upon further depression of the valve stem 26 in the direction of arrow D, the degree of engagement between the compressible sealing member 68 and the annular sealing edge 70 increases and the at least one radial passageway(s) 50 eventually ceases to be sealed by the valve gasket 30 so that the at least one radial passageway(s) 50 is brought into fluid communication with the metering chamber 58. Once this occurs, a portion of the product, contained within the metering chamber 58, is permitted to flow radially inwardly, through the at least one radial passageway(s) 50, and axially along the central passageway 42 of the valve stem 26 to the actuator 38 and be dispensed by the actuator 38 into the surrounding environment. Due to the engagement between the compressible sealing member 68 and the annular sealing edge 70, only a portion of the product contained within the metering chamber 58, e.g., about 30 to 300 microliters, is permitted to be dispensed by the metering valve assembly 10 regardless how long or to what degree or extent the valve stem 26 is depressed by an operator. Once the pressure within the metering chamber 58 becomes essentially atmospheric, no further product is able to be dispensed from the metering chamber 58.

When the applied depression force is removed from the valve stem 26, the valve stem 26 is biased, due to the action of the compression spring 28, in the direction of arrow U into its closed position. As this occurs, the fluid communication between the metering chamber 58 and the at least one radial passageway(s) 50 is first interrupted. Once this occurs, further movement of the valve stem 26, in a direction of arrow U, re-establishes communication between the filling chamber 78 and the metering chamber 58 so that the product to be dispensed is again allowed to flow through the dip tube 74 into the internal cavity 24 of the valve housing 22 and replenish the supply of product contained within the metering chamber 58. Such replenishing facilitates dispensing of further product to be dispensed each time the valve stem 26 is sufficiently depressed by an operator. Due to the bias of the spring 28, the valve stem 26 is normally in its closed position and further product can not be dispensed from the metering valve assembly 10 until the valve stem 26 is again sufficiently depressed, in the direction of arrow D, to first initially partition or separate the filling chamber 78 from the metering chamber 58 and, thereafter, establish a product flow path from the metering chamber 58 to the actuator 38 via the at least one radial passageway(s) 50 and the central passageway 42.

Figure 7:
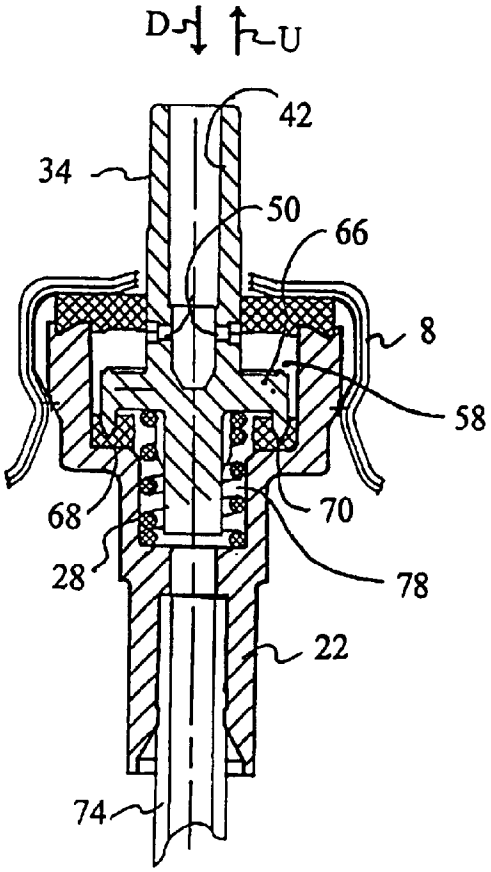
FIG. 7 is a diagrammatic cross-sectional view, of the metering valve assembly of FIG. 5, showing the fully depressed position of the metering valve assembly so that the product contents, from the metering chamber, are discharged out through the stem.
Figure 6:
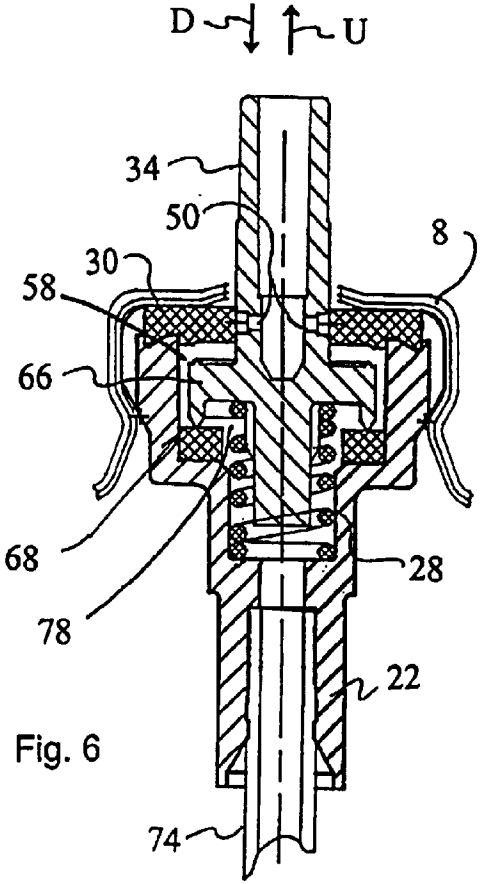
FIG. 6 is a diagrammatic cross-sectional view, of the metering valve assembly of FIG. 5, showing the metering valve assembly in a partially depressed position where the valve stem seals with the annular sealing edge of the valve housing.
Figure 5:
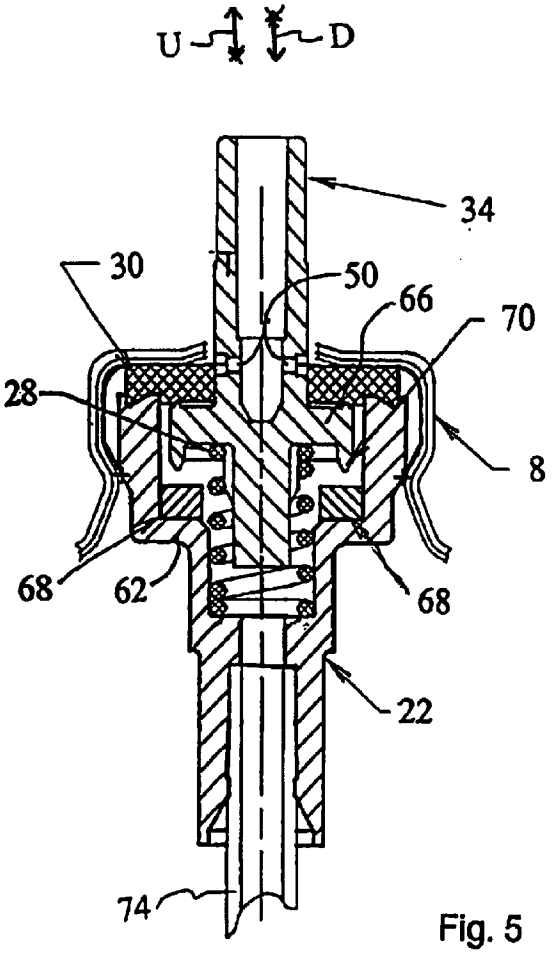
FIG. 5 is a diagrammatic cross-sectional view of a second embodiment of the metering valve assembly, according to the present invention, shown in a normally biased closed position.

With reference now to FIGS. 5–7, a brief description concerning a second embodiment of the metering valve assembly 10 will now be provided. As this embodiment is very similar to the first embodiment, a detailed description concerning only the differences between the first and second embodiments will be provided.

The major difference between the first embodiment and the second embodiment is the location of the compressible sealing member 68 and the annular sealing edge 70. According to this embodiment, the downwardly facing surface of the annular flange 66 is provided with an integral annular sealing edge 70 while an upwardly facing and mating surface of the base wall 62 is provided with the compressible sealing member 68. The compressible sealing member 68 may be adhesively secured to or otherwise permanently affixed to the base wall 62 of the valve housing 22 to ensure a permanent attachment thereto. Alternatively, the compressible sealing member 68 may merely be secured to the downwardly facing surface of the annular flange 66 by a slight interference fit with the interior cavity 24 of the valve housing 22. The compressible sealing member 68 and the annular sealing edge 70 are normally spaced apart from one another by a small distance, e.g., about 0.020 of an inch to about 0.040 of an inch so that when the valve stem 26 is at least partially depressed, the compressible sealing member 68 engages with the annular sealing edge 70 to form a fluid tight seal between those two components. The spring 28 urges the valve stem 26, away from the base wall 62, into its elevated normally closed position. As with the first embodiment, upon initially engagement between the compressible sealing member 68 and the annular sealing edge 70, the at least one radial passageway(s) 50 is still normally closed by abutting engagement between the valve portion 34 of the valve stem 26 and the valve gasket 30.

The annular sealing edge 70 and the compressible sealing member 68 together facilitate dividing, separating or partitioning the internal cavity 24 of the valve housing 22 into the centrally located filling chamber 78 and the radially outwardly located metering chamber 58. Accordingly, as with the first embodiment, when the valve stem 26 is sufficiently depressed in the direction of arrow D, the valve stem 26 partially compresses the spring 28 and moves the annular flange 66 and the annular sealing edge 70, supported by the undersurface thereof, into an abutting engagement with the compressible sealing member 68. Once the compressible sealing member 68 and the annular sealing edge 70 sufficiently engaged with one another, such engagement partitions the internal cavity 24 into the filling chamber 78 and the radially outwardly located metering chamber 58. Such engagement prevents the further flow of product to be dispensed from the filling chamber 78 to the metering chamber 58. It is to be appreciated that the valve gasket 30 is still maintained in sealing engagement with the exterior surface of the valve portion 34 of the valve stem 26 (see FIG. 6) so that the dispensing of product through the at least one radial passageway(s) 50 and the central passageway 42 is not permitted.

Upon further depression of the valve stem 26 in the direction of arrow D, the degree of engagement between the compressible sealing member 68 and the annular sealing edge 70 increases and the at least one radial passageway(s) 50 eventually ceases to be sealed by the valve gasket 30 so that the at least one radial passageway(s) 50 is brought into fluid communication with the metering chamber 58 (see FIG. 7). Once this occurs, a portion of the product, contained within the metering chamber 58, is permitted to flow radially inwardly, through the at least one radial passageway(s) 50, and axially along the central passageway 42 of the valve stem 26 to the actuator 38 and be dispensed by the actuator 38 into the surrounding environment. Due to the engagement between the compressible sealing member 68 and the annular sealing edge 70, only a portion of the product contained within the metering chamber 58, e.g., about 30 to 300 microliters, is permitted to be dispense by the metering valve assembly 10 regardless how long or to what degree or extent the valve stem 26 is depressed by an operator. Once the pressure within the metering chamber 58 becomes essentially atmospheric, no further product is able to be dispensed from the metering chamber 58.

When the applied depression force is removed from the valve stem 26, the valve stem 26 is biased, due to the action of the compression spring 28, in the direction of arrow U into its closed position. As this occurs, the fluid communication between the metering chamber 58 and the at least one radial passageway(s) 50 is first interrupted. Once this occurs, further movement of the valve stem 26, in a direction of arrow U, re-establishes communication between the filling chamber 78 and the metering chamber 58 so that the product to be dispensed is again allowed to flow through the dip tube 74 into the internal cavity 24 of the valve housing 22 and replenish the supply of product contained within the metering chamber 58. Such replenishing facilitates dispensing of further product to be dispensed each time the valve stem 26 is sufficiently depressed by an operator. Due to the bias of the spring 28, the valve stem 26 is normally in its closed position and further product can not be dispensed from the metering valve assembly 10 until the valve stem 26 is again sufficiently depressed, in the direction of arrow D, to first initially partition or separate the filling chamber 78 from the metering chamber 58 and, thereafter, establish a product flow path from the metering chamber 58 to the actuator 38 via the at least one radial passageway(s) 50 and the central passageway 42.

The metering chamber is designed to hold a volume of between 30 and 300 microliters of the product to be dispensed, more preferably the metering chamber is designed to hold a volume of between 40 and 100 microliters of the product to be dispensed metering chamber and preferably the metering chamber is designed to hold about 50 microliters of the product to be dispensed. The annular sealing edge 70 preferably has a diameter of between about 0.18 of an inch and about 0.25 of an inch and has a height of between about 1/32 of an inch and about 1/16 of an inch. The compressible sealing member 68 preferably has a diameter of between about 0.20 of an inch and about 0.30 of an inch and has a thickness of between about 0.045 of an inch and about 0.070 of an inch. The compressible sealing member is preferably manufactured from rubber, some other elastomeric material or from some other suitable gasket or seal material. Such arrangement ensures a sufficient sealing between the compressible sealing member 68 and the annular sealing edge 70 when the valve stem 26 is sufficiently depressed.

In order to fill the container 2 with a desired propellant and product, a charging head (not shown) is connected to a source product and/or propellant (not shown) under relatively high pressure, e.g. 900 psig, and the charging head is designed to surround and sealingly engage with the top surface of the mounting cup or ferrule 8 to facilitate charging of the pressurized component(s). During the filing process, e.g., typically a button-off-filling process, the charging head is first lowered into a sealingly engagement with the container 2 to prevent the inadvertent escape of propellant and/or product during the charging process. A product charging path is established by the charging head along an exterior surface of the valve stem 26 and the aperture 36 in the ferrule 8 and then between a top surface of the gasket 30, as it is at least partially spaced from an inwardly facing surface of the ferrule 8, e.g. a few thousandths of an inch or so, to form a propellent and/or product flow path therebetween. The propellant and/or product continues to flow radially along the inwardly facing surface of the ferrule 8, between the ferrule 8 and the gasket 30, and then axially down along the inwardly facing surface of the ferrule 8, between the ferrule 8 and the exterior surface of the valve housing 22, until the propellent and/or product reaches the product/propellent cavity of the pressurized container 2. Upon completion of the charging process, the charging head is withdrawn.

The term "ferrule" as used throughout the specification and in the following claims, is interchangeable with the term "mounting cup" and is to be construed in such manner.

Since certain changes may be made in the above described improved metering valve assembly, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A metering valve assembly comprising:

a ferrule having an aperture formed therein;

a valve housing having an inlet provided in a wall thereof, the valve housing defining an internal cavity which accommodates an annular flange of a valve stem and a compression spring therein, and a valve gasket closing the internal cavity;

the valve housing being attached to the ferrule such that a stem portion of the valve stem protrudes through an aperture provided in the valve gasket and through the aperture provided in the ferrule; and the stem portion having a central passageway formed therein communicating with a dispensing outlet of the metering valve assembly, and an opposite end of the central passageway communicating with at least one radial passageway; and the at least one radial passageway being normally closed by the valve gasket due to the spring normally biasing the valve stem into a closed position;

wherein one of an undersurface of the annular flange of the valve stem and a mating surface of the valve housing is provided with a compressible sealing member and the other of the undersurface of the valve stem and the mating surface of the valve housing has an annular edge protruding axially therefrom and the compressible sealing member and the annular edge engage with one another to form a seal therebetween, when the valve stem is sufficiently depressed, to partition the interior cavity into a metering chamber and a separate filling chamber so that product may be dispensed only from the metering chamber when a product flow path is established between the metering chamber and the dispensing outlet of the valve stem.

2. The metering valve assembly according to claim 1, wherein a first end of a dip tube is coupled to the inlet of the valve housing to facilitate conveying product from an aerosol container into the interior cavity of the valve housing.

3. The metering chamber according to claim 1, wherein an actuator is attached to a remote end of the valve stem to facilitate dispensing of the product from the dispensing outlet of the metering valve assembly.

4. The metering valve assembly according to claim 1, wherein the compressible sealing member has a diameter of between about 0.20 of an inch and about 0.30 of an inch and has a thickness of between 0.045 of an inch and 0.070 of an inch and the annular edge protrudes axially from one of the undersurface of the valve stem and the mating surface of the valve housing by a distance of between about 1/32 and about 1/16 of an inch.

5. The metering valve assembly according to claim 1, wherein the annular edge has a diameter of between about 0.18 of an inch and about 0.25 of an inch and has a height of between about 1/32 of an inch and about 1/16 of an inch.

6. The metering valve assembly according to claim 1, wherein the metering chamber defines volume between 30 microliters and 300 microliters.

7. The metering valve assembly according to claim 1, wherein the at least one radial passageway is sealed by the valve gasket until the valve stem of the metering valve assembly is in its open position whereby the valve gasket only allows product to flow into the at least one radial passageway once the compressible sealing member and the annular edge partition the interior cavity into the metering chamber and the filling chamber.

8. The metering valve assembly according to claim 1, wherein the compressible sealing member is sealingly compressed prior to any product being dispensed from the metering chamber through the at least one radial passageway and out the discharge outlet of the metering valve assembly to prevent inadvertent throttling of the metering valve assembly.

9. The metering valve assembly according to claim 1, in combination with a container having an opening therein, and the ferrule gasket sealingly engaging with the opening of the container to form a aerosol container for dispensing a product to be dispensed.

10. The metering valve assembly according to claim 1, wherein a base wall of the valve housing has the inlet formed therein, and a first end of a dip tube is received by the inlet, and the dip tube facilitates conveyance of the product to be dispensed to the interior cavity of the valve housing.

11. The metering valve assembly according to claim 1, wherein the annular flange has an annular rib and the spring normally biases the annular rib of the annular flange into sealing engagement with the valve gasket to provide a fluid tight seal therebetween and maintain the metering valve assembly in a normally closed position.

12. The metering valve assembly according to claim 1, wherein the metering valve assembly further includes an actuator button having a product inlet which receives and fits over an exterior surface of the stem portion of the valve stem, and the product inlet communicates with the dispensing outlet via the at least one radial passageway.

13. The metering valve assembly according to claim 1, wherein the at least one radial passageway has a cross-sectional dimension of between about 0.011 and 0.040 of an inch.

14. The metering valve assembly according to claim 1, wherein the compressible sealing member has a diameter of between about 0.20 of an inch and about 0.30 of an inch.

15. The metering valve assembly according to claim 1, wherein the compressible sealing member has a thickness of between 0.045 of an inch and 0.070 of an inch and, when the valve stem is depressed toward a base of the valve housing, the compressible sealing member is compressed axially to reduce an axial thickness of the compressible sealing member.

16. The metering valve assembly according to claim 1, wherein the compressible sealing member is manufactured from one of rubber, an elastomeric material, a gasket material and a seal material.

17. A method of metering dispensing of product through a metering valve assembly, the method comprising the steps of:

forming an aperture in a ferrule;

providing an inlet in a wall of a valve housing and defining, via the valve housing, an internal cavity which accommodates an annular flange of a valve stem and a compression spring therein, and closing the internal cavity with a valve gasket;

attaching the valve housing to the ferrule such that a stem portion of the valve stem protrudes through an aperture provided in the valve gasket and through the aperture provided in the ferrule; and forming a central passageway in the stem portion which communicates with a dispensing outlet of the metering valve assembly, while an opposite end of the central passageway communicates with at least one radial passageway; and normally closing the at least one radial passageway with the valve gasket due to the spring normally biasing the valve stem into a closed position;

providing one of an undersurface of the annular flange of the valve stem and a mating surface of the valve housing with a compressible sealing member and providing the other of the undersurface of the valve stem and the mating surface of the valve housing with an annular edge protruding axially therefrom; and forming a seal between the compressible sealing member and the annular edge when the valve stem is sufficiently depressed and the compressible sealing member directly engages with the annular edge, to partition the interior cavity into a metering chamber and a separate filling chamber, so that product may be dispensed only from the metering chamber when a product flow path is established between the metering chamber and the dispensing outlet of the valve stem.

18. The metering valve assembly according to claim 1, wherein the annular edge protrudes axially from one of the undersurface of the valve stem and the mating surface of the valve housing by a distance of at least about 1/16 of an inch.

19. The metering chamber according to claim 1, wherein the annular edge and the compressible sealing member are bath located between the annular flange of the valve stem and a base of the valve housing, and as the annular flange is depressed toward the base of the valve housing, the annular edge only axially compresses the compressible sealing member without radially compressing the compressible sealing member.

20. A metering valve assembly comprising:

a valve housing defining an internal cavity which accommodates an annular flange of a valve stem and a compression spring therein, a valve gasket closing the internal cavity, and the valve housing having an inlet;

the stem portion having a central passageway formed therein communicating with a dispensing outlet of the metering valve assembly, and an opposite end of the central passageway communicating with at least one normally closed radial passageway;

wherein one of an undersurface of the annular flange of the valve stem and a mating surface of the valve housing has a compressible sealing member and the other of the undersurface of the valve stem and the mating surface of the valve housing has an annular wall axially protruding therefrom, a remote end of the annular wall supports an annular edge, and the annular wall and the annular edge engage with one another to form a seal therebetween, when the valve stem is sufficiently depressed, to partition the interior cavity into a metering chamber and a separate filling chamber so that product may be dispensed only from the metering chamber when a product flow path is established between the metering chamber and the dispensing outlet of the valve stem.

21. A metering valve assembly comprising:

a ferrule having an aperture formed therein;

a valve housing having an inlet provided in a wall thereof, the valve housing defining an internal cavity which accommodates an annular flange of a valve stem and a compression spring therein, and a valve gasket closing the internal cavity;

the valve housing being attached to the ferrule such that a stem portion of the valve stem protrudes through an aperture provided in the valve gasket and through the aperture provided in the ferrule; and the stem portion having a central passageway formed therein communicating with a dispensing outlet of the metering valve assembly, and an opposite end of the central passageway communicating with at least one radial passageway; and the at least one radial passageway being normally closed by the valve gasket due to the spring normally biasing the valve stem into a closed position;

wherein one of an undersurface of the annular flange of the valve stem and a mating surface of the valve housing has a compressible sealing member and the other of the undersurface of the valve stem and the mating surface of the valve housing has an annular wall axially protruding therefrom, a remote end of the annular wall supports an annular edge, and the annular wall and the annular edge engage with one another to form a seal therebetween, when the valve stem is sufficiently depressed, to partition the interior cavity into a metering chamber and a separate filling chamber so that product may be dispensed only from the metering chamber when a product flow path is established between the metering chamber and the dispensing outlet of the valve stem; and the annular edge and the compressible sealing member are both located between the annular flange of the valve stem and a base of the valve housing, and upon initial actuation of the metering valve assembly, the annular flange is moved toward the base of the valve housing so that the annular edge initially engages with and initially axially compresses an annular area of the compressible sealing member, and, upon further actuation of the metering valve assembly so as to establish product flow between the metering chamber and the dispensing outlet, the annular edge further axially compresses the same annular area of the compressible sealing member.

* * * * *